US005366347A

United States Patent [19]

Hoglund

[11] Patent Number: 5,366,347

[45] Date of Patent: Nov. 22, 1994

[54] SUSPENSION PUMP WITH BUILT-IN VARIABLY ECCENTRIC LIQUID RING PUMP

[75] Inventor: Ronny Hoglund, Skoghall, Sweden

[73] Assignee: Kamyr Aktiebolag, Karlstad, Sweden

[21] Appl. No.: 75,558

[22] PCT Filed: Dec. 16, 1991

[86] PCT No.: PCT/SE91/00865

§ 371 Date: Jun. 14, 1993

§ 102(e) Date: Jun. 14, 1993

[87] PCT Pub. No.: WO92/11458

PCT Pub. Date: Jul. 9, 1992

[30] Foreign Application Priority Data

Dec. 19, 1990 [SE] Sweden ..... 9004050

[51] Int. Cl.[5] ..... F04C 19/00; F04D 29/02

[52] U.S. Cl. ..... 417/53; 417/69; 417/90; 415/169.1

[58] Field of Search ..... 417/53, 68, 69, 219, 417/900; 415/169.1

[56] References Cited

U.S. PATENT DOCUMENTS

| | | | |
|---|---|---|---|
| 3,072,057 | 1/1963 | Esau de Silva Rosa | 417/69 |
| 4,776,758 | 10/1988 | Gullichsen | 415/168 |
| 4,921,400 | 5/1990 | Niskanen . | |
| 4,981,413 | 1/1991 | Elonen et al. . | |
| 5,078,573 | 1/1992 | Peroaho et al. | 417/69 |
| 5,228,290 | 7/1993 | Speggiorin | 417/219 |

FOREIGN PATENT DOCUMENTS

| | | | |
|---|---|---|---|
| 286776 | 8/1913 | Germany . | |
| 323255 | 7/1920 | Germany . | |
| 335674 | 4/1921 | Germany . | |
| 43462 | 6/1938 | Netherlands | 417/68 |
| 608984 | 5/1978 | U.S.S.R. | 417/68 |

*Primary Examiner*—Richard A. Bertsch
*Assistant Examiner*—Roland G. McAndrews, Jr.
*Attorney, Agent, or Firm*—Cushman, Darby & Cushman

[57] ABSTRACT

A pump for pumping pulp, comprising a first impeller (12) for pumping the pulp in fluidized state, and a gas evacuation pump (23) of liquid ring type comprising a pump housing (24) with a chamber (25) and a second impeller (26) rotating therein for evacuating gas collecting in front of said first impeller (12) via a system of channels (20, 21, 22), said impellets (12, 26) being mounted on the same shaft (4) for common rotation. According to the invention the chamber (24) of the gas evacuation pump (23) containing a rotating liquid ring (29) is defined circumferentially by an element (40) which is movable in relation to the second impeller (26) and the axis of rotation (5) thereof by means of an actuator (48, 50, 51), said element (40) being adjustable by the actuator (48, 50, 51) in three different operating positions dependent on the operating conditions prevailing for the pump.

8 Claims, 6 Drawing Sheets

SUSPENSION PUMP WITH BUILT-IN VARIABLY ECCENTRIC LIQUID RING PUMP

FIELD OF THE INVENTION

The present invention relates to a pump for pumping a suspension of cellulosic fibrous material, comprising a housing having an inlet and an outlet for the suspension, said outlet being substantially perpendicular to the inlet, a shaft rotatable about an axis of rotation with which the inlet is concentric, a fluidizing rotor for fluidizing the suspension, a first impeller for pumping the fluidized suspension, and a gas evacuation pump of liquid ring type comprising a pump housing with a cylindrical chamber and a second impeller rotating therein for evacuating gas collecting in front of said first impeller via a system of channels, said chamber having an inlet for said gas and an outlet for said gas which is displaced circumferentially substantially 180° in relation to the inlet, and said chamber containing a liquid ring which rotates together with the second impeller and which defines blade pockets between itself and the blades of the second impeller to transport gas from the inlet to the outlet, the rotor and said two impellers being mounted on said shaft and rotating therewith.

BACKGROUND OF THE INVENTION

A suspension pump with a built-in gas evacuation pump of the type described above is previously known through U.S. Pat. No. 4,776,758, however, the gas evacuation pump functions only as a vacuum pump. Since the vacuum pump and the suspension pump are driven by a common shaft the vacuum pump cannot be disconnected in those cases when no gas is separated out from the suspension- The vacuum pump must therefore operate under extremely varying conditions, both in different installations and in one and the same installation. Suspension pumps in down pipes containing pulp of medium consistency at a low level and much air require a vacuum pump with high capacity in order to be able to evacuate sufficiently large quantities of air at low pressure on the inlet side of the suspension pump. Suspension pumps operating with high pulp levels on the inlet side, e.g. a suspension pump installed at the bottom of a storage tower, need only be de-aired when the pulp level drops below 15 m. At higher levels the vacuum pump works towards a closed outlet and contributes to unnecessary power consumption, however other problems may arise as will be clear below.

When the level of pulp in a storage tower is high, normally above 15 m, the pressure at the inlet to the pump is high, e.g. 2 bar, and no air will therefore be separated out from the pulp. The pressure inside the pump, at the centre of the impeller is considerably above atmospheric pressure. Under such operating conditions—high inlet pressure and no air separation—the vacuum pump will be filled with pulp and its outlet must be closed. When the vacuum is operating against a closed outlet in this way, and is filled with pulp, considerable pressure variations occur which lead to cavitation and mechanical stress.

When the level of the pulp is mid-way in the storage tower, usually 7–15 m, the pressure at the inlet to the pump will be correspondingly lower, e.g. 1 bar, and some of the air will therefore be separated out in the pump, disturbing the pumping process. The pressure at the centre of the impeller is still above atmospheric pressure, and it is difficult to evacuate air without the fibre suspension being pressed out at the same time. The outlet from the vacuum pump must therefore be throttled. However, such throttling causes the outlet to become blocked by fibres and to solve this problem the outlet is flushed clean with water from a pipe which is connected to the outlet before the throttle valve.

When the level of the pulp is low in the storage tower, usually below 7 m, the pressure at the inlet to the pump will be correspondingly lower, atmospheric pressure and below, so that large and varying amounts of air in the pulp will be separated out in the pump, disturbing the pumping process. The pressure at the centre of the impeller is now below atmospheric pressure, and the air is withdrawn by means of the vacuum pump. Since the amounts of air separated out vary from one time to another, the pressure will vary. Theefore, in order to maintain the pressure constant, make-up air is added via a conduit provided with a pressure-sensitive valve which is set at predetermined negative pressure, e.g. −0,4 bar. Furthermore, the built-in vacuum pump must be dimensioned for a capacity corresponding to the worst possible operating conditions, i.e. it must be able to evacuate the largest possible amounts of air which can be separated out from the pulp at low pressures.

It is clear from the above that there are three different operating conditions for the pump with built-in vacuum pump, that can appear in one and the same pump installation, namely:

1. Low inlet pressure, below atmospheric pressure, and large amounts of air which are separated out in the pump.
2. Medium inlet pressure, above atmospheric pressure, and air separation in the pump.
3. High inlet pressure, above atmospheric pressure, and no air separation in the pump.

It is recognized that in the second and third operating conditions the built-in vacuum pump results in certain drawbacks. A problem also exists in the first operating condition since make-up air must be added in order to maintain constant pressure in dependence on the varying amounts of air separated out in front of the impeller. There is also considerable risk of the channel system for the make-up air being out of function due to pulp having penetrated into the channel system during the first and second operating conditions so that the vacuum pump must be dismantled to allow cleaning of the channel system. Obviously this entails interruptions in operation.

SUMMARY OF THE INVENTION

The object of the present invention is to eliminate the problems mentioned above and provide a suspension pump having a built-in, commonly driven Gas evacuation pump, the capacity of which and manner of functioning can be adapted to prevailing operating conditions with respect to the pressure at the inlet to the suspension pump and the amount of Gas which should be removed from the suspension pump in order to maintain its pump capacity.

This object is achived by means of the present invention in that the chamber of the gas evacuation pump containing the liquid ring is defined circumferentially by an element which is disposed to be movable in relation to the second impeller and the axis of rotation thereof, that an actuator is disposed to move said element, said element being adjustable by means of the actuator in different operating positions dependent on the operating conditions prevailing for the pump, said operating positions comprising first eccentric operating positions for the axis of rotation of the liquid ring in relation to the axis of rotation of the second impeller, in which first eccentric operating positions said blade pockets together with the liquid ring enclose volumes of gas which decrease in the direction to the outlet, second eccentric operating positions for the axis of rotation of the liquid ring in relation to the axis of rotation of the second impeller, in which second eccentric operating positions said blade pockets together with the liquid ring enclose volumes of gas which increase in the direction to the outlet, and a third operating position in which the axis of rotation of the liquid ring coincides with the axis of rotation of the second impeller and said blade pockets together with the liquid ring enclose volumes of gas which remain constant from the inlet to the outlet.

By means of the invention one and the same gas evacuation pump can deal with the varying operating conditions described in the introduction and denoted 1, 2, and 3. The third operating condition is fulfilled by the gas evacuation pump running idle, i.e. the liquid ring has no displacement interaction with the impeller, since it is concentric therewith. The second operating condition is fulfilled by the liquid ring being displaced eccentrically in relation to the impeller so that the gas volumes in the blade pockets increase towards the gas outlet and are thus greater at the outlet than at the inlet. The gas evacuation pump consequently functions in this case as a sluice feeder and gas can be extracted from a higher pressure, i.e. above atmospheric pressure, to a lower pressure (atmospheric pressure) in a controlled manner. The throttling device used previously, with a throttle valve in the outlet pipe is no longer necessary, and it therefore follows that no special pipe is necessary for rinsing a clogged throttle valve. The first operating condition is fulfilled by the liquid ring in this case also being displaced eccentrically in relation to the impeller, but in a different direction, so that the gas volumes in the blade pockets decrease towards the gas outlet and are therefore smaller here than at the gas inlet. The gas evacuation pump functions in this case as a vacuum pump and the gas is withdrawn from a lower pressure, i.e. negative pressure, to a higher pressure, i.e. atmospheric pressure. Contrary to the known vacuum pump, the invention enables an increase or a decrease in the capacity of the gas evacuation pump, adjusting it to the various amounts of gas separated from the pump during pumping depending on alterations in the inlet pressure. Varying the capacity in accordance with the invention, and adjusting the capacity to the requirements prevailing at any one time, means that the make-up air previously used is now unnecessary. Such adjustment can be effected automatically by means of a suitable control function which influences the setting of the capacity of the gas evacuation pump depending on the pulp level or the pressure prevailing on the inlet side of the suspension pump.

BRIEF DESCRIPTION OF THE DRAWINGS

The invention will be described further in the following with reference to the drawings.

DETAILED DESCRIPTION OF THE INVENTION

Figure 1:
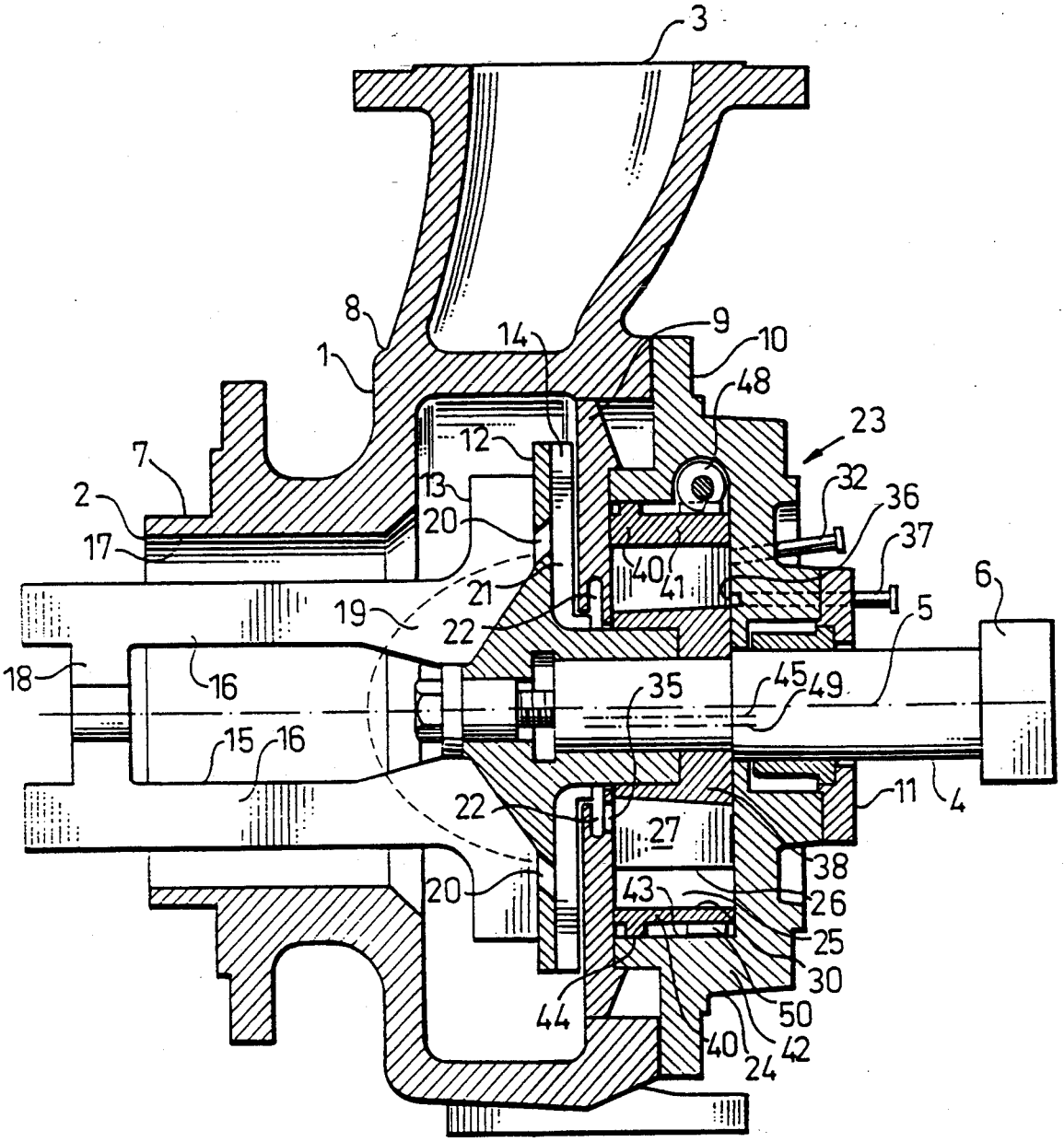
FIG. 1 is a longitudinal section through a suspension pump with a built-in gas evacuation pump in accordance with the present invention.

With reference to FIG. 1, this shows a suspension pump for pumping a suspension of a cellulosic fibrous material, particularly paper pulp of medium consistency, i.e. about 6–15% dry solids. Conventional centrifugal pumps cannot be used for this consistency. The suspension pump comprises a main housing 1 which has an inlet 2 and an outlet 3 for the suspension. The outlet 3 is substantially perpendicular to the inlet 2. The suspension pump has a shaft 4 which is rotatable about an axis of rotation 5 and is driven by a motor 6. The inlet 2 is concentric in relation to the rotating shaft 4. The housing 1 has a cylindrical portion 7 extending from the inlet 2, and a portion 8 which is radially enlarged in relation to the cylindrical portion and is provided with said outlet 3 for the suspension. A wall means closes the suspension pump at the end opposite the inlet 2, said wall means comprising an inner wall element 9 and an outer wall element 10, said shaft 4 extending through these wall elements 9, 10. Seals 11 provide the necessary sealing between the shaft 4 and the outer wall element 10 of the housing.

The suspension pump comprises a first impeller 12 of radial wheel type, mounted on the shaft 4 to rotate in the radially enlarged housing portion 8. The suspension impeller 12 is provided with a plurality of front blades 13 the lateral edges of which facing the suspension inlet 2 and a plurality of rear blades 14 the lateral edges of which facing the inner wall element 9.

Further, the suspension pump is provided with a fluidizing rotor 15, mounted on the shaft 4 via the first impeller 12. The rotor comprises a plurality of blades 16 which are secured to the first impeller 12 and extend at a distance from the axis of rotation 5 and the cylindrical inner surface 17 of the housing portion 7. The rotor blades 16 are extended past the inlet 2 and are joined by cross stays 18. The suspension pump may be disposed horizontally or vertically in an opening in the bottom of a container containing pulp of medium consistency. During their rapid rotation the rotor blades 16 cause the pulp to move at such high speed and cause such turbulence in the pulp that this is fluidized into a condition which can be pumped. Depending on the pressure prevailing in the inlet 2 to the pump the gas present in smaller or larger amounts in the fiber suspension may be collected in front of the impeller 12 during the fluidizing process, producing a gas bubble 19. The gas is removed via a channel system comprising a plurality of small holes 20 in the first impeller 12, the inner portion 21 of the space between the first impeller 12 and the inner wall element 9, and a passage 22 through the inner wall element 9.

Furthermore, the suspension pump is equipped with a gas evacuation pump 23 of liquid-ring type, comprising a pump housing 24 with a cylindrical chamber 25 and a second impeller 26 rotating therein. The impeller 26 has a plurality of blades 27 defining pockets 28 between them and a liquid ring 29. The gas evacuation pump includes adjacent portions of the inner and outer wall elements 9, 10 so that between them they define the chamber 25 of the gas evacuation pump. The impeller 26 of the gas evacuation pump is mounted on the shaft 4, to rotate together with the first impeller 12 and the rotor 15 about the axis of rotation 5 in the direction indicated in FIG. 2. In order to achieve a suction effect during a certain operating condition, i.e. when gas is separated out from the suspension and a negative pressure prevails inside the suspension pump, the chamber 25 is disposed eccentrically in relation to the impeller 26, the chamber 25 containing said liquid ring 29 which thus has the same eccentricity as the chamber 25 since the liquid ring 29 slides along the cylindrical inner side 30 of the chamber. The radial dimension of the liquid ring 29 is adjusted so that its inner eccentric surface 31 in circumferential direction lies entirely within the length of the blades 27. In other words, the outer ends of the blades 27 are located within the liquid ring 29. Liquid for regulating the size of the liquid ring is supplied through a conduit 32 (FIG. 1). Since the liquid ring 29 is eccentric in relation to the impeller 26, said blade spaces 28 will be gradually enlarged on the suction side 34 of the gas evacuation pump and become gradually smaller on its pressure side 33 seen in the direction of rotation of the impeller 26, as is clear from FIG. 2 and also from FIG. 3.

The gas evacuation pump has an arc-shaped inlet 35 to the chamber 25 and an arc-shaped outlet 36 from the chamber. The outlet 36 communicates with a conduit 37 (FIG. 1) for removal of the gas evacuated from the center of the suspension pump. The outlet 36 is disposed in the inner surface of the outer wall element 10 and has therefore been shown in broken lines in FIGS. 2–7. The inlet 35 forms the orifice of the passage 22 which extends axially through the inner wall element 9. The inlet 35 and outlet 36 are disposed close to the hub 38 of the impeller 26. The inlet 35 expands and the outlet 35 narrows in the direction of rotation of the impeller 26. The radially outermost edge 39 of the outlet 36 determines the size of the liquid ring 29. Excess of liquid will therefore be pressed out through the outlet 36.

The pump housing 24 comprises an element 40 which is movable in relation to the axis of rotation 5 of the impeller 26. The inner surface 30 of the element 40 defines said chamber 25 in circumferential direction with respect to the axis of rotation 5 of the impeller 26, the liquid ring 29 moving around the inner surface 30. The element 40 is disposed to be adjusted in different operating positions in dependence on prevailing operating conditions of the pump including the installation thereof. In the operating position according to FIG. 2 the liquid ring 29 has maximum eccentricity in relation to the impeller 26. In a further operating position according to FIG. 4 the liquid ring 29 is concentric with the impeller 26. The element 40 can thus also be set in any desired intermediate position between said two positions described, in order to adjust the capacity of the gas evacuation pump depending on the amount of gas which is collecting in front of the first impeller 12.

Figure 2:
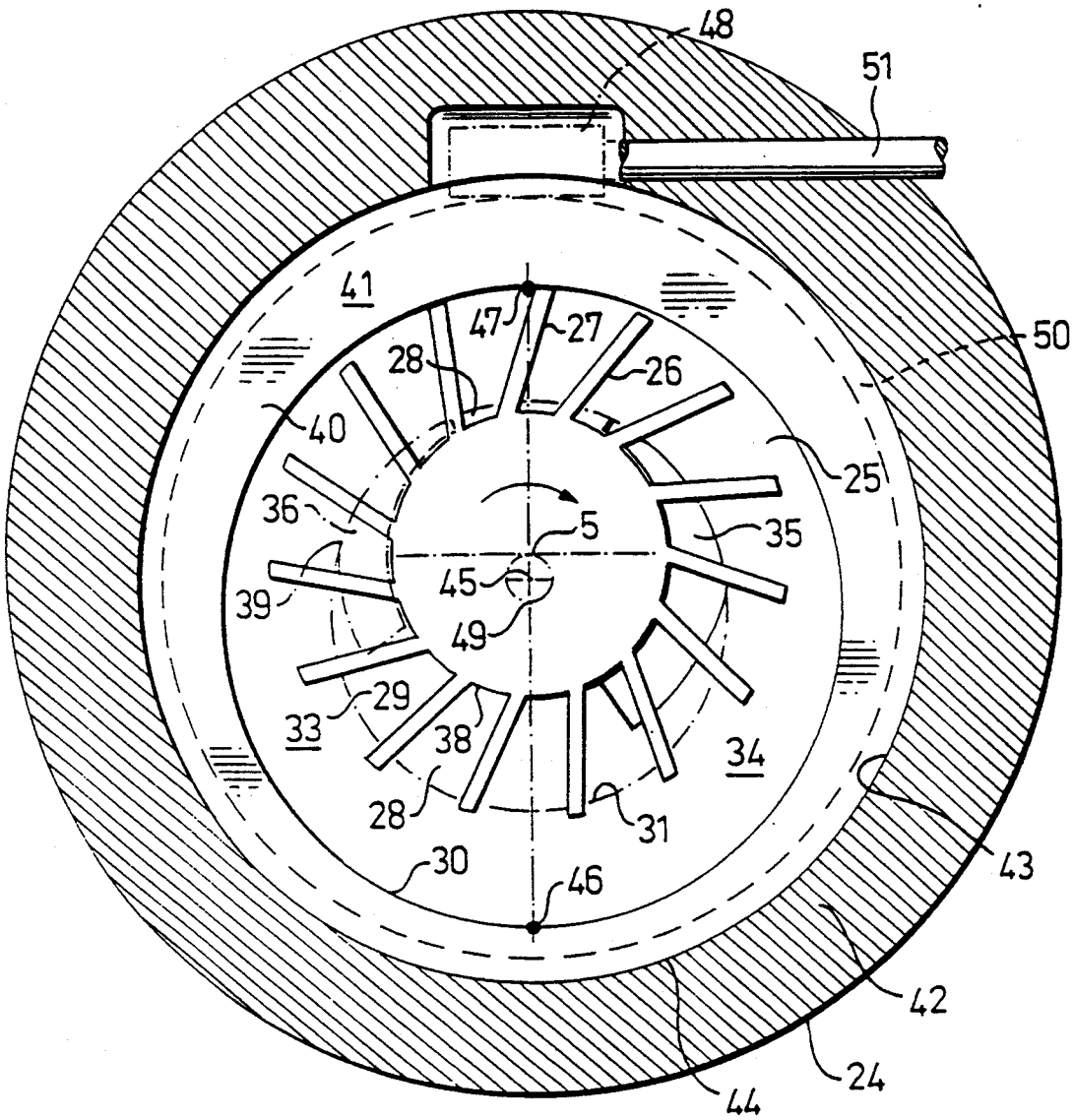
FIGS. 2–5 are cross sections through the gas evacuation pump according to FIG. 1 and illustrate four different operating positions.
Figure 3:
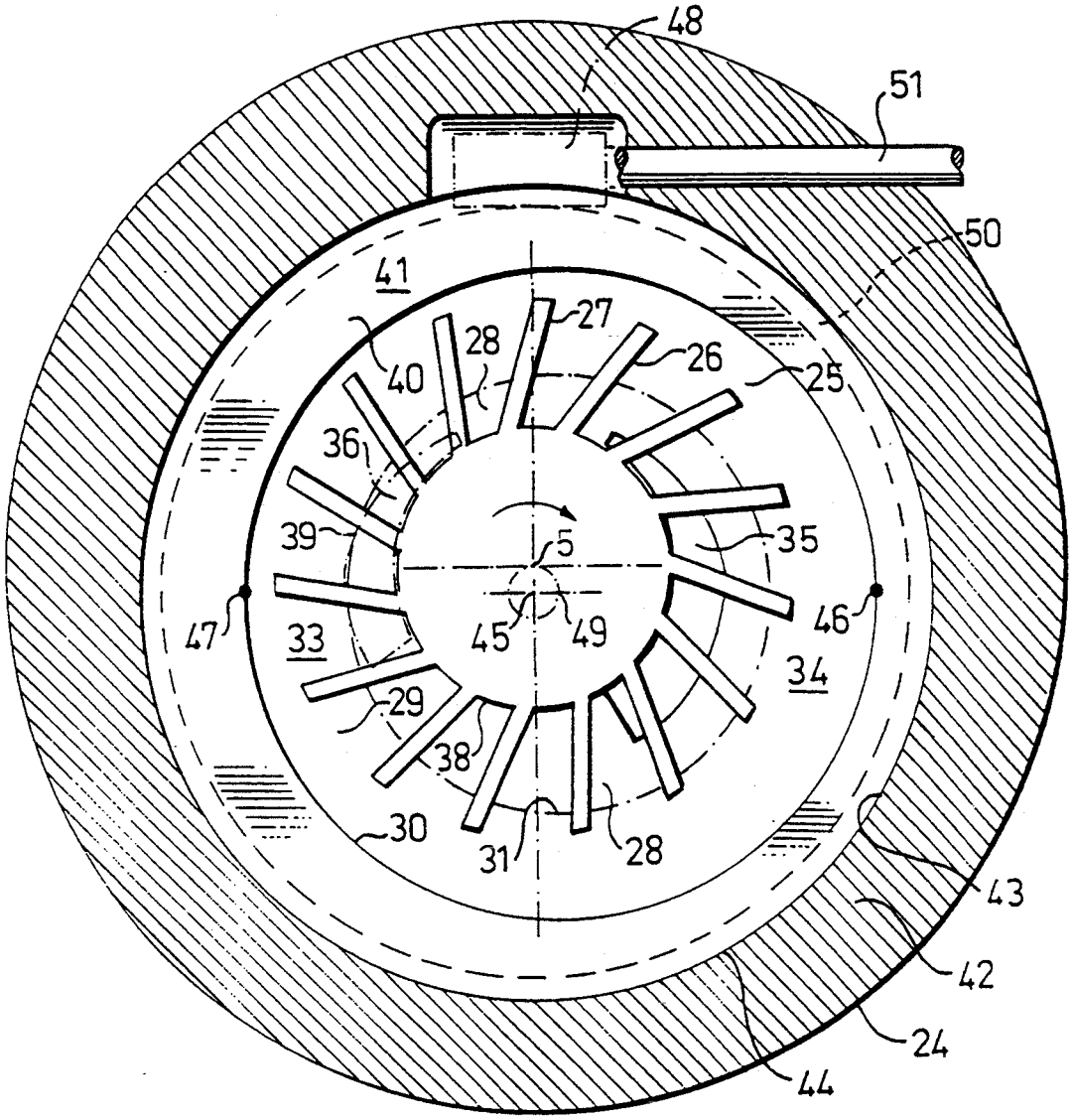
Figure 4:
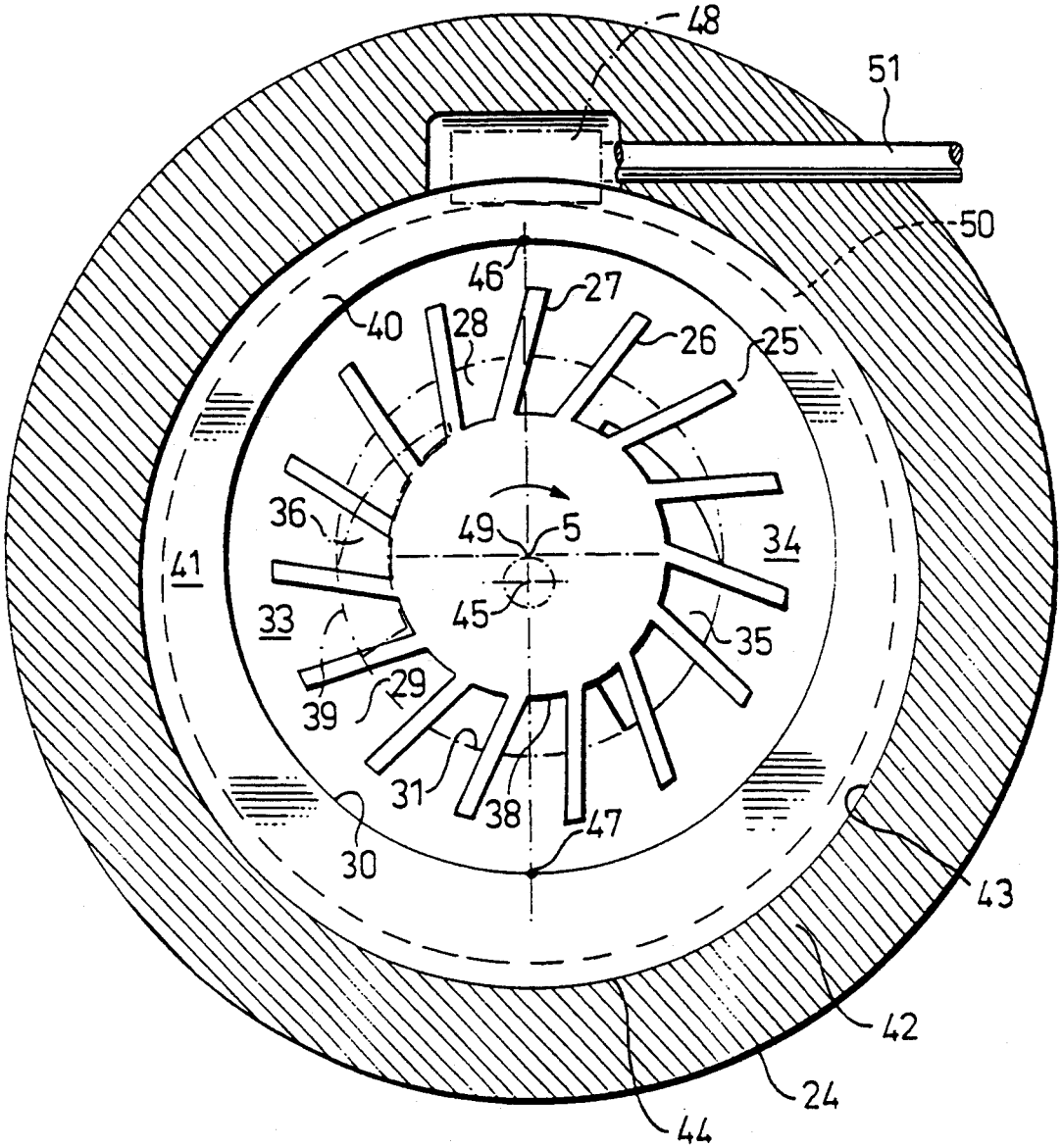

In the embodiment shown in FIGS. 1–5 the movable element 40 consists of a turnable ring 41 which is journalled in a radially outer portion 42 of the pump housing 24. The portion 42 has a cylindrical inner surface 43, and the turnable ring 41 has a cylindrical outer surface 44 with substantially the same radius as the inner surface 43 of the portion 42 so that the ring 41 can be turned around in the portion 42, the inner surface 43 and outer surface 44 being in sliding cooperation with each other. The axis of rotation 45 of the turnable ring 41 is eccentrically displaced in relation to the axis of rotation 5 of the impeller 26. To achieve the adjustable suction effect endeavoured to according to the invention the axis of rotation 45 of the ring 41 is also located eccentrically in relation to the axis of rotation 49 of the liquid ring 29, said axis of rotation 49 also constituting the center of the inner surface 30 of the ring 41. It thus follows that the radial thickness of the ring 41 varies and increases in both directions from a reference point 46 to the 180° opposite reference point 47, and that the inner surface 30 and outer surface 44 of the ring 41 are eccentric in relation to each other as well as being eccentric in relation to the axis of rotation 5 of the impeller 26. The greatest suction effect is obtained when the liquid ring 29 has the greatest eccentricity in relation to the axis of rotation 5 of the impeller 26 or, in other words, when the axis of rotation 49 of the liquid ring 29 is located at the furthest possible distance from the axis of rotation 5 of the impeller 26, when at the same time the blades 27 on the opposite side of the axis of rotation 5 of the impeller 26 in relation to the axis of rotation 49 of the liquid ring 29 pass close to the inner surface 30 of the ring 41 (as close as possible). In the embodiment shown, with a turnable ring 41, its axis of rotation 45 is located exactly between the axis of rotation 5 of the impeller 26 and the axis of rotation 49 of the liquid ring 29 when said maximum suction effect is achieved, and a plane through these three centres thus intersects said reference points 46, 47 at the narrowest and thickest portions, respectively, of the ring 41. Turning of the ring 41 is achieved by means of a worm screw 48 which is mounted in the outer portion 42 of the pump housing, and a toothed rim 50 on the outside of the ring 41 with which the worm screw 48 is in engagement, as shown in FIG. 1. By turning the ring 41 with the help of the worm screw 48 via a rod 51 extending through the pump housing, the capacity of the gas evacuation pump can be steplessly reduced until it is finally zero, as illustrated in FIG. 4, when the ring 41 has been turned 180° and the axis of rotation 49 of the liquid ring 29 coincides with the axis of rotation 5 of the impeller 26. FIG. 3 illustrates an intermediate position with reduced capacity, when the ring 41 has been turned 90° and the axis of rotation 49 of the liquid ring 29 has been displaced in a corresponding arc in relation to FIG. 2.

Figure 5:
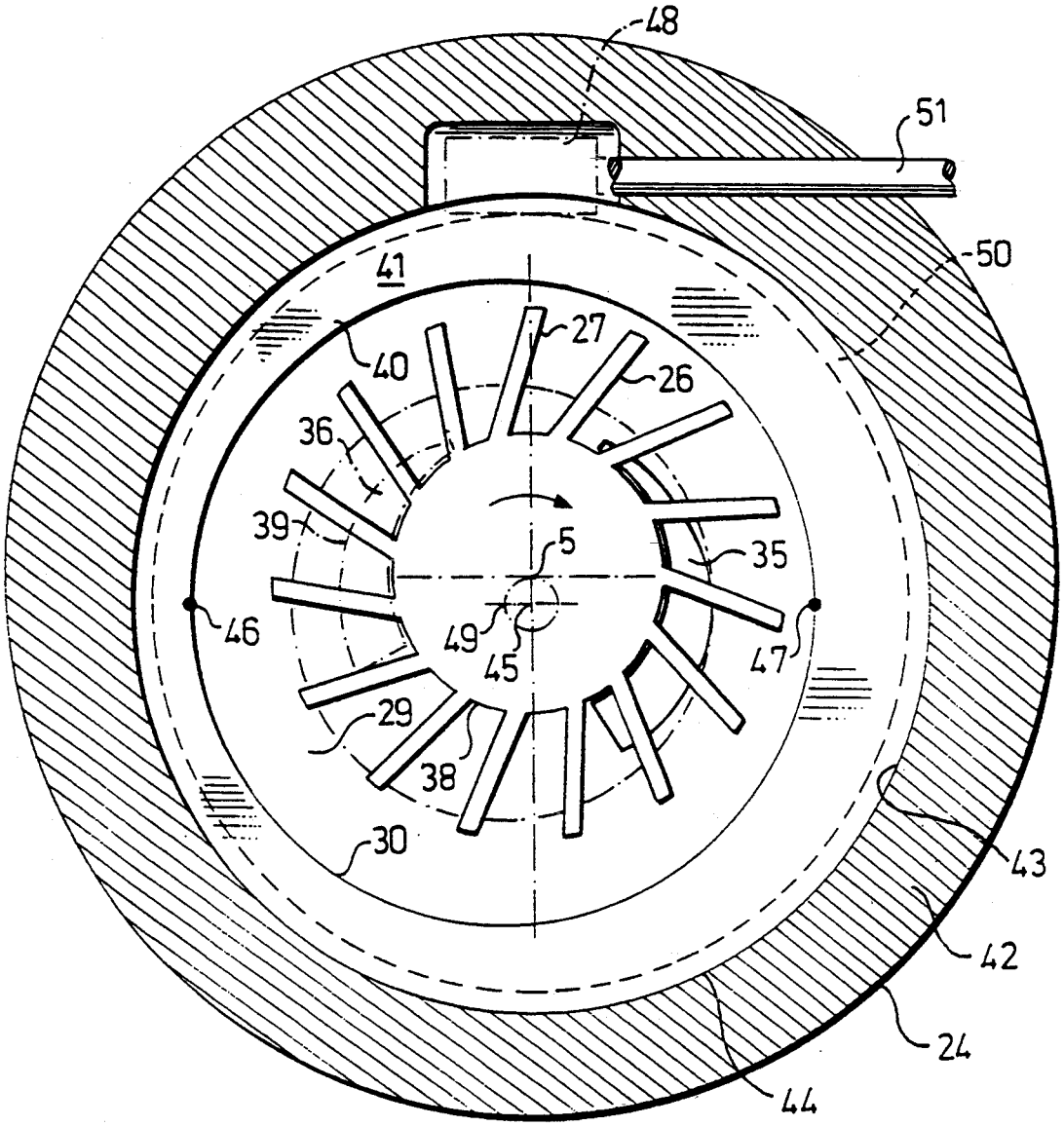

Continuing to turn the ring 41 counter-clockwise from the position shown in FIG. 4 or clockwise from the position shown in FIG. 2 will give other eccentric operating positions for the axis of rotation 49 of the liquid ring 29 in relation to the axis of rotation 5 of the impeller 26. Such a second eccentric operating position is illustrated in FIG. 5, where the ring 41 has been turned 45° in relation to the idle running operating position shown in FIG. 4 and 45° in relation to the maximum first eccentric operating position, i.e. maximum suction effect, according to FIG. 2. As will be seen from FIG. 5 the blade pockets 28 and the liquid ring 29 enclose gas volumes which increase in the direction to the outlet 86, i.e. the volumes of gas are greater at the outlet 36 than at the inlet 35. In this case the gas evacuation pump does not function as a vacuum pump, but rather as a sluice arrangement to feed gas at high pressure from the inlet 35 to the outlet 36 under expansion so that the pressure is lowered in a controlled manner.

Figure 6:
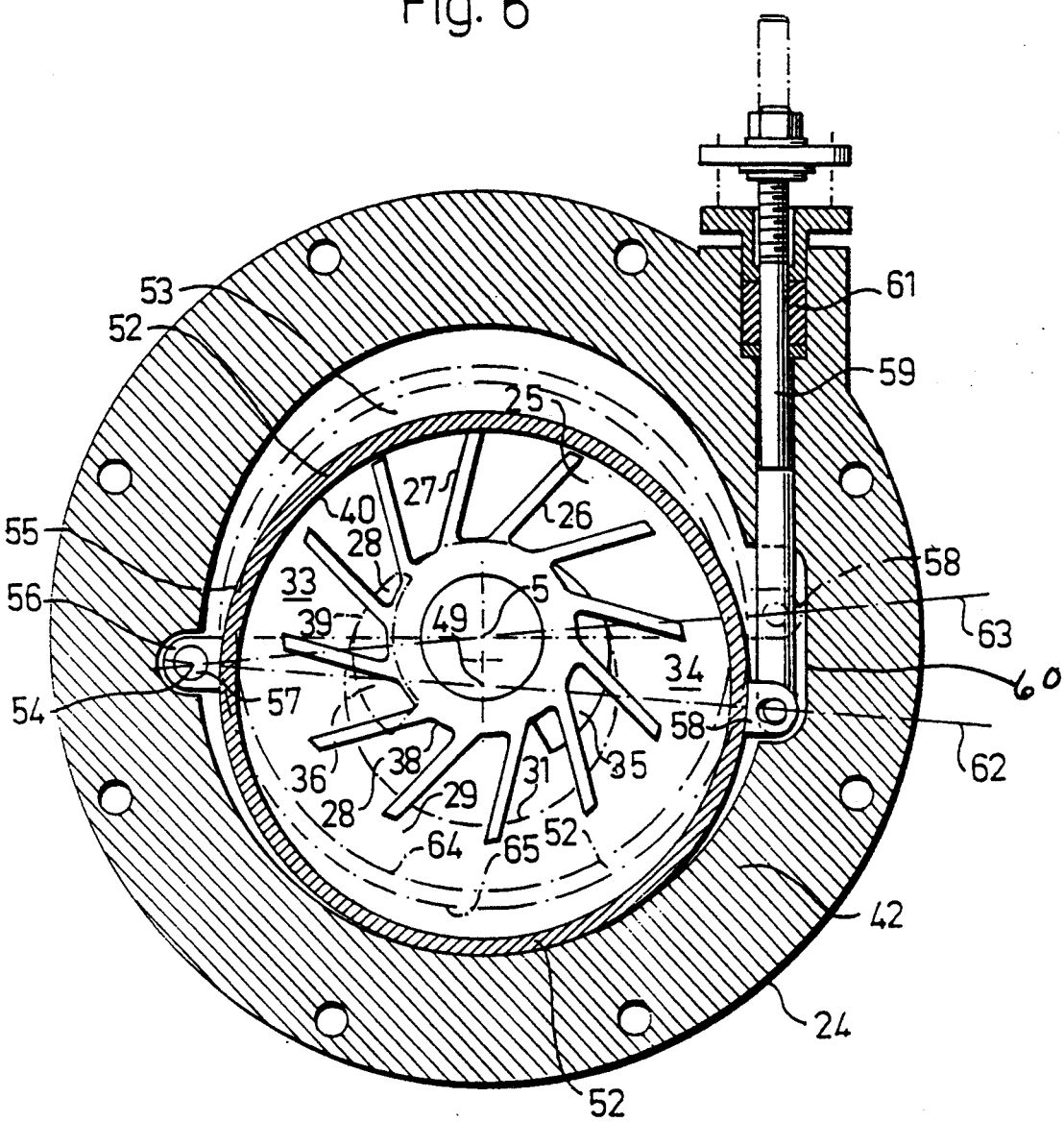
FIG. 6 is a cross section through a gas evacuation pump according to another embodiment of the invention.

FIG. 6 shows a second embodiement of a gas evacuation pump with adjustable capacity depending on the amount of gas to be evacuated from the centre of the suspension pump. In this case also, the movable element 40 consists of a ring 52, but the radial thickness is constant. The interior of the pump housing has been enlarged to provide also a space 53 outside the ring. The ring 52 is pivotably journalled about a pivot axis 54 which is parallel to the axis of rotation 5 of the impeller 26. A lug 56 is provided on the outer surface 55 of the ring 52 to journal a shaft pivot 57 mounted in the pump housing 24 and also forming said pivot axis 54. On the opposite side of the ring 52 is an actuator comprising a similar lug 58 and a rod 59 mounted to the lug 58 and extending tangentially out of the pump housing 24 to be actuated for movement in its longitudinal direction out or into the pump housing 24 as required. A recess 60 is formed in the pump housing 24 to allow place for the tangential movement of the lug 58. A seal 61 provides the necessary sealing between the rod 59 and the pump housing 24. The pivot axis 54 and the lug 56 of the actuator are so arranged in relation to each other that, when the ring 52 is in its lowest operating position resulting in maximum suction effect of the gas evacuation pump, and in its idle running operating position resulting in a suction effect of zero of the gas evacuation pump, the two lines 62, 63 which intersect the pivot axis 54 and the lug 58 of the actuator form an angle of 9°, thus in the idle running operating position said line 63 intersects the axis of rotation 5 of the impeller 26. Movement of the ring 52 between said two operating positions is thus effected by a corresponding movement of the rod 59. The ring 52 is concentric with the impeller 26 in said idle running operating position which thus means that no displacement occurs, and there is consequently no suction effect. The concentric, idle running operating position of the ring 52 is shown in broken lines in FIG. 6. In this embodiment, besides the first eccentric operating positions described, it is also possible to set the ring 59 and the liquid ring 29 enclosed by the ring in second eccentric operating positions, by swinging the ring 59 upwardly past said concentric, idle running operating position so that gas at high pressure is sluiced out to the surroundings, i.e. the atmosphere, in the same way as described for the first embodiment.

In a further embodiment of the invention (not shown), the movable element 40 is so disposed in the pump housing 24 that the axis of rotation 49 of the liquid ring 29 is moved linearly instead of in an arc as is the case in the two embodiments shown. While the element 40 forms a cylindrical chamber 25 as in the two embodiments shown, the outer contour of the element 40 may be rectangular, e.g. quadratic, in which case the interior of the pump housing 24 is correspondingly rectangular, having two parallel sides for sliding cooperation with the element 40 which is connected to an actuator which is actuacted externally.

I claim:

1. A pump comprising a main housing including a suspension inlet and a suspension outlet generally transverse to said suspension inlet, a shaft rotatable about an axis of rotation substantially in alignment with said inlet, a fluidizing impeller mounted on said shaft for rotation therewith for effecting fluidization of suspension pumped by said fluidizing impeller from said inlet to said outlet, said fluidizing impeller when rotating causing gas to separate from the suspension and to collect adjacent said shaft; a vacuum pump including a vacuum pump housing and a vacuum impeller, said vacuum impeller being mounted on said shaft for rotation with said shaft and said fluidizing impeller, means defining gas passageways extending between said main housing to said vacuum impeller, to be exhausted from said main housing to an area remote from said main housing by said vacuum pump, said vacuum pump housing having a common wall with said main housing, means defining an open annular volume in said vacuum pump housing, an annular element being disposed in said annular volume, said vacuum impeller having blades extending from an imperforate hub so that, in operation, said blades of said vacuum impeller will form a liquid ring with said blades intersection with said liquid ring defining blade pockets to transport gas collecting in the pockets from said inlet to said outlet of said vacuum housing, said vacuum pump having an actuator for moving said element relative to said shaft between different operating positions including a position where said element is concentric relative to said axis of rotation and where said element is eccentric relative to said axis of rotation, said blades of said vacuum impeller and the liquid ring forming gas pockets which decrease in volume upon rotation of said vacuum impeller toward said outlet of said vacuum housing when said element is in one eccentric position relative to said axis of rotation, said blades of said vacuum impeller and the liquid ring forming gas pockets which increase in volume upon rotation of said vacuum impeller toward said outlet of said vacuum housing when said element is in another position relative to said axis of rotation and said blades of said vacuum impeller and the liquid ring forming gas pockets which remain substantially constant in volume upon rotation of said vacuum impeller toward said outlet of said vacuum housing when said element is in said concentric position relative to said axis or rotation.

2. The pump as claimed in claim 1, where said annular element comprises a ring rotatably journalled in said vacuum pump housing to thereby alter the position of the axis of rotation of the liquid ring during operation in relation to the axis of rotation of said vacuum impeller.

3. The pump as claimed in claim 2, wherein said actuator includes a toothed rim disposed on the outside of said ring, a worm screw cooperating with said toothed rim and having a rod extending to the outside of said vacuum pump housing to actuate said ring by means of said rod.

4. The pump as claimed in claim 2, wherein said annular element has a pivot axis located externally of said ring adjacent its periphery.

5. The pump as claimed in claim 4 wherein said actuator includes a rod extending from said ring externally of said vacuum pump housing and being pivotally connected to said ring at a point located on the side of said ring opposite to said axis of rotation of said ring.

6. A method of adjusting the capacity of a gas evacuation pump of the liquid ring type and constructed with a pump for pumping a suspension of cellulosic fibrous material, said gas evacuation pump being of the type driven together with said suspension pump and comprising a pump housing having a cylindrical chamber and an impeller rotating therein for a evacuating gas which is separated out of the suspension and collected in said evacuation pump through a system of channels, said chamber having an inlet for said gas and an outlet for said gas which is displaced circumferentially substantially 180° in relation to said inlet, said chamber having a vacuum impeller including blades extending from an imperforate hub which operate with a liquid to form a liquid ring upon rotation and with said blades of said vacuum impeller forming blade pockets between said blades and said liquid ring to transport gas from said inlet to said outlet of said chamber, said vacuum chamber including an annular element which is movable in relation to the axis of rotation of said vacuum impeller, the method comprising the steps of adjusting the axis of rotation of said annular element relative to said axis of rotation of said impeller from a first position where said annular element is eccentrically located relative to said axis of rotation of said vacuum impeller where said blade pockets together with the liquid ring enclose volumes of gas which decrease in the direction of rotation toward said outlet of said chamber, to a second eccentric operating position in relation to the axis of rotation of said vacuum impeller in which said volumes of gas in said blade pockets increase in the direction of rotation of said vacuum impeller toward said outlet and in a third position in which the axis of rotation of said liquid ring and said vacuum impeller are concentric and said volumes of gas in said blade pockets remain constant in moving from said inlet to said outlet.

7. The method as claimed in claim 6, including the step of exposing said inlet to constant pressure and moving said annular element so as to be concentric relative to said axis of rotation of said vacuum impeller.

8. The method as claimed in claim 7 in which said inlet is exposed to varying pressure in operation and said annular element is set at an eccentric position relative to said axis of rotation of said vacuum impeller.

* * * * *